US010429877B1

(12) United States Patent
Aboudina et al.

(10) Patent No.: US 10,429,877 B1
(45) Date of Patent: Oct. 1, 2019

(54) LOW-VOLTAGE REFERENCE CURRENT CIRCUIT

(71) Applicant: GOODIX TECHNOLOGY INC., San Diego, CA (US)

(72) Inventors: Mohamed Aboudina, San Diego, CA (US); Ahmed Emira, San Diego, CA (US); Hassan Elwan, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/993,629

(22) Filed: May 31, 2018

(51) Int. Cl.
*G05F 3/26* (2006.01)

(52) U.S. Cl.
CPC ..... *G05F 3/262* (2013.01)

(58) Field of Classification Search
None
See application file for complete search history.

(56) References Cited

U.S. PATENT DOCUMENTS

| | | | | |
|---|---|---|---|---|
| 8,654,600 | B1 | 2/2014 | Pollachek | |
| 2010/0157672 | A1* | 6/2010 | Barkley | G11C 7/04 365/185.03 |
| 2012/0025801 | A1* | 2/2012 | Hirose | G05F 3/242 323/313 |

FOREIGN PATENT DOCUMENTS

| | | | |
|---|---|---|---|
| CN | 104090625 | A | 10/2014 |
| CN | 105867518 | A | 8/2016 |

OTHER PUBLICATIONS

International Search Reprt dated Jun. 2019 in the corresponding PCT application (application No. PCT/CN2018/116261).

* cited by examiner

*Primary Examiner* — Cassandra F Cox
(74) *Attorney, Agent, or Firm* — Kilpatrick Townsend & Stockton, LLP

(57) ABSTRACT

A current reference circuit includes a current source, a first p-channel metal oxide semiconductor (PMOS) transistor having a source coupled to a first supply voltage, a gate, and a drain coupled to the current source, and an n-channel MOS (NMOS) transistor having a drain coupled to a second supply voltage, a gate coupled to the drain of the first PMOS transistor. The current reference circuit also includes a first resistive element having a first terminal coupled to a source of the NMOS transistor and a gate of the first PMOS transistor and a second terminal coupled to a ground potential, a second PMOS transistor having a drain coupled to the first supply voltage, and a second resistive element having a first terminal coupled to the first terminal of the first resistive element and a second terminal coupled to the gate of the second PMOS transistor.

20 Claims, 3 Drawing Sheets

LOW-VOLTAGE REFERENCE CURRENT CIRCUIT

FIELD OF THE INVENTION

The present invention relates generally to current reference circuits, and more particularly to current reference circuits that operate at low voltages.

BACKGROUND OF THE INVENTION

Integrated circuit components continue to shrink in size, and demands in battery-powered devices continue to increase. Reference current circuits are widely used in integrated circuits to generate bias currents. However, as supply voltages fall, some commonly used reference current circuits can no longer operate or operate poorly under low voltage conditions. Thus, the supply voltage represents one of the challenges in the design of reference current circuits. Most analog systems are supplied with a battery voltage. Generating a reference current from a battery voltage generally provides good performance in terms of leakage current and output resistance, but with a relatively high power consumption. Generating a reference current from a low supply voltage enables a small silicon area and low power consumption, but requires the use of core devices that have the drawbacks of current leakage and low output resistance. Further, as the supply voltage decreases, conventional reference current circuits may not function properly. Another challenge is the low noise requirement. A low noise reference current circuit requires filter capacitors, however, a gate leakage current flowing through the filter capacitors causes a voltage shift in the current mirror circuit of the reference current circuit, thereby affecting the matching of the current mirror circuit. Yet another challenge is the required accuracy of the reference current circuit. Thus, a low supply voltage faces the problems of a current leakage that can significantly affect a current mirror performance, and a low output resistance of a current mirror may require an output buffer to drive an output load.

Accordingly, there is a need for improved circuits for generating an accurate low-noise current reference with low supply voltages.

BRIEF SUMMARY OF THE INVENTION

Embodiments of the present application provide a novel current reference circuit that operates at a low voltage supply. In one aspect of the present invention, a current reference circuit may include a current source, a first p-channel metal oxide semiconductor (PMOS) transistor having a source coupled to a first supply voltage, a gate, and a drain coupled to the current source, and an n-channel MOS (NMOS) transistor having a drain coupled to a second supply voltage, a gate coupled to the drain of the first PMOS transistor. The current reference circuit also includes a first resistive element having a first terminal coupled to a source of the NMOS transistor and a gate of the first PMOS transistor and a second terminal coupled to a ground potential, a second PMOS transistor having a drain coupled to the first supply voltage, and a second resistive element having a first terminal coupled to the first terminal of the first resistive element and a second terminal coupled to the gate of the second PMOS transistor.

In another aspect of the present invention, a current mirror may include a current source, a first p-channel metal oxide semiconductor (PMOS) transistor having a source coupled to a first supply voltage, a gate, and a drain coupled to the first current source, a second PMOS transistor having a source coupled to the first supply voltage, a gate coupled to the gate of the first PMOS transistor, and a drain configured to provide a second current source, and an n-channel MOS (NMOS) transistor having a drain coupled to a second supply voltage, a gate coupled to the first current source, and a source coupled to the gate of the first PMOS transistor.

The following detailed description together with the accompanying drawings will provide a better understanding of the nature and advantages of the present invention.

BRIEF DESCRIPTION OF THE DRAWINGS

The accompanying drawings, referred to herein and constituting a part hereof, illustrate embodiments of the disclosure. The drawings together with the description serve to explain the principles of the invention.

DETAILED DESCRIPTION OF THE INVENTION

The present invention will be understood more fully from the detailed description given below and from the accompanying drawings of the preferred embodiments of the invention, which, however, should not be taken to limit the invention to the specific embodiments, but are for explanation and understanding only. The embodiments are described in sufficient detail to enable one of skill in the art to practice the invention. Other embodiments may be utilized and structural, logical, and electrical changes may be made without departing from the scope of the present invention.

It will be understood that, when an element or component is referred to as "adjacent to," "connected to," or "coupled to" another element or component, it can be directly adjacent to, connected or coupled to the other element or component, or intervening elements or components may also be present. In contrast, when an element is referred to as being "directly connected to," or "directly coupled to" another element or component, there are no intervening elements or components present between them. It will be understood that, although the terms "first," "second," "third," etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terms "a", "an" and "the" may include singular and plural references. It will be further understood that the terms "comprising", "including", having" and variants thereof, when used in this specification, specify the presence of stated features, steps, operations, elements, and/or components, but do not preclude the presence or addition of one or more other features, steps, operations, elements, components, and/or groups thereof. Furthermore, as used herein, the words "and/or" may refer to and encompass any possible combinations of one or more of the associated listed items.

The use of the terms first, second, etc. do not denote any order, but rather the terms first, second, etc. are used to distinguish one element from another. Furthermore, the use of the terms a, an, etc. does not denote a limitation of quantity, but rather denote the presence of at least one of the referenced items. The terms "current reference circuit," "current reference device," "current mirror," "current mirror circuit," and "current mirror device" are used interchangeably.

Figure 1:
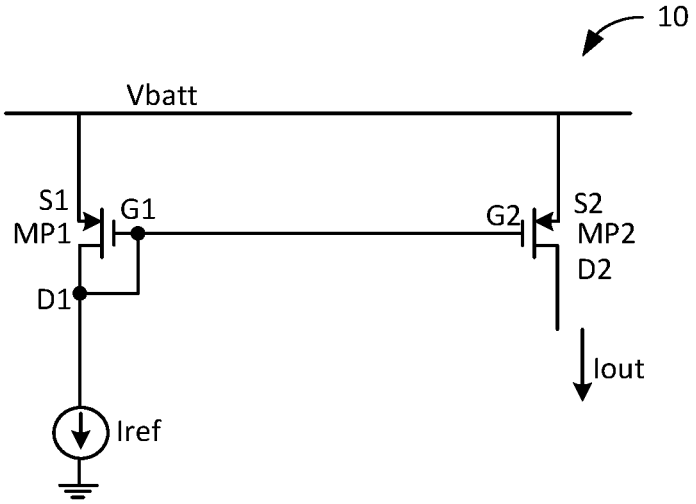
FIG. 1 is a schematic diagram of a current mirror circuit used as a reference circuit for explaining embodiments of the present invention.

FIG. 1 is a schematic diagram of a current mirror circuit 10 used as a reference for explaining embodiments of the present invention. Current mirror circuit 10 includes two matching p-channel metal oxide semiconductor (MOS) transistors MP1 and MP2, and a current reference source Iref. MP1 has a source S1 coupled to a battery supply voltage Vbatt, a gate G1 and a drain D1 coupled together forming a diode. MP2 has a source S2 coupled to the battery supply voltage Vbatt, a gate G2 coupled to the gate G1 of MP1, and a drain D2 that provides an output current Iout to a load. Since the gates of MP1 and MP2 are connected together, when MP1 and MP2 have the same dimension (e.g., W/L ratio), the output current Iout is equal to the current reference source Iref.

As discussed in the background section, continuing reduction in feature sizes of semiconductor devices provides improvement in device performance in terms of lower power consumption and higher switching speed. MOS transistor performance may be improved by reducing the thickness of the gate dielectric layer. However, a thin gate dielectric layer may result in gate tunneling leakage currents, especially at high supply voltages. Therefore, a semiconductor device may have a core region having a low-voltage power source and an input/output (IO) region having a high-voltage power source. The core region includes core devices that have low-threshold voltages (e.g., 0.4V to 0.5V), and the IO region includes IO devices that have high-threshold voltages (e.g., 0.9V to 1.0V). The threshold voltage of a MOS transistor is defined as the gate voltage required to turn the transistor on or off depending upon the type of the transistor. As used herein, a high-voltage power source may have a supply voltage that is the battery voltage (e.g., 1.5V to 4.5V), and a low-voltage power source may have a supply voltage that is lower than the battery voltage (e.g., 1.0V or less).

Current mirror circuit 10 works well when the supply voltage Vbatt is sufficient high to provide certain voltage headroom for the p-channel MOS transistors and the current reference source. For example, the p-channel MOS transistors are disposed in the input/output (TO) region of an integrated circuit, the voltage across the drain and source of the p-channel MOS transistor MP1 may be about 1V to be in the saturation region, and the voltage at the current reference source Iref may be greater than 0.5V for its proper operation. That is, current mirror circuit 10 can only functions properly with a supply voltage greater than 1.5V.

Figure 2:
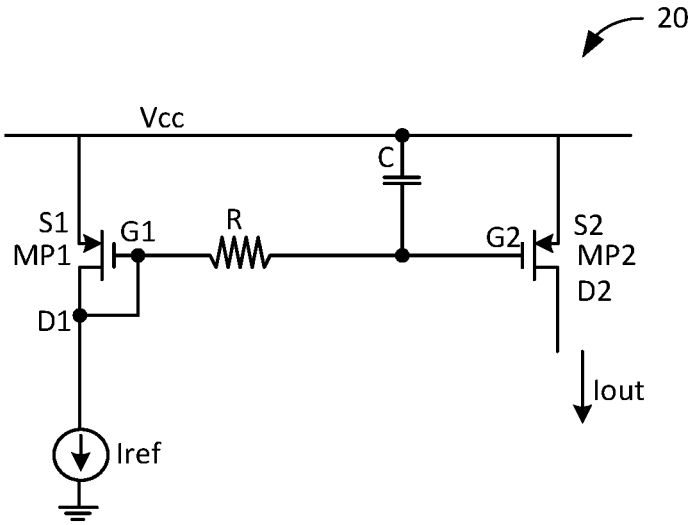
FIG. 2 is a schematic diagram of another current mirror circuit used as a reference circuit for explaining embodiments of the present invention.

FIG. 2 is a schematic diagram of a low-noise current mirror circuit 20 that is a modification of current mirror circuit 10 of FIG. 1. Referring to FIG. 2, the p-channel transistors MP1 and MP2 are located in the core region of an integrated circuit so that they can operate at a lower drain-source voltage, e.g., at about 0.5V. In the embodiment, the voltage at the current reference source Iref may be about 0.4V for a proper operation. That is, current mirror circuit 20 may operate with a core voltage supply Vcc in the range between 0.9V and 1.0V. Current mirror circuit 20 also includes a resistor R having a resistance value that is coupled between the gates of the p-channel MOS transistors MP1 and MP2, and a capacitor C having a capacitance value that is coupled between the supply voltage Vcc and the gate G2 of the p-channel MOS transistor MP2. The resistor R and the capacitor C form a low-pass filter that filters high frequency contents of the current reference source Iref that is above the cut-off frequency of the low-pass filter. The cut-off frequency is defined by the time constant RC of the low-pass filter.

Thus, the RC low-pass filter can filter out noise of the current reference source Iref. However, the low-pass filter may cause a gate tunneling current leakage due to the thin gate dielectric layer that adversely affects the current mirroring performance of current mirror circuit 20 when the transistors MP1 and MP2 each are core devices. Further, the current reference source Iref rises with the supply voltage Vcc and affects thus the performance of current mirror circuit 20. Thus, it is desirable to have transistors with higher threshold voltages to reduce current leakage and power consumption by using IO devices for the transistors MP1 and MP2. Unfortunately, IO devices with higher threshold voltages require higher supply voltages.

Figure 3A:
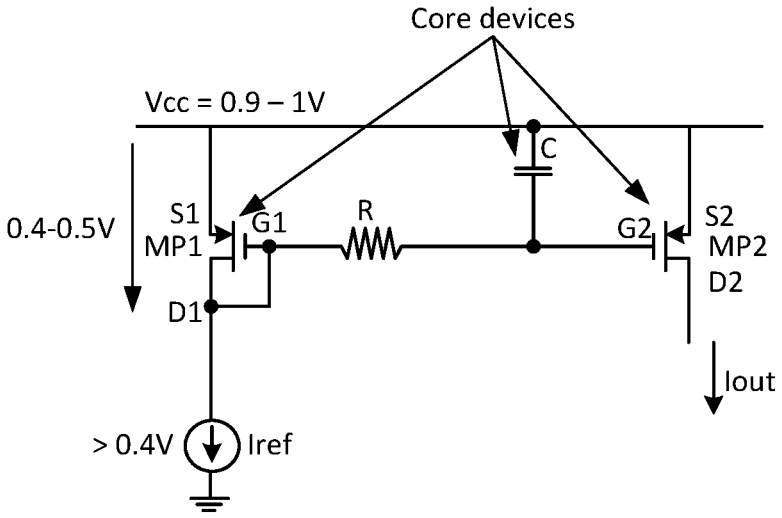
FIG. 3A is a circuit diagram illustrating exemplary voltage values of the low-noise current mirror circuit of FIG. 2 when the transistor MP1 and MP2 are core devices.
Figure 3B:
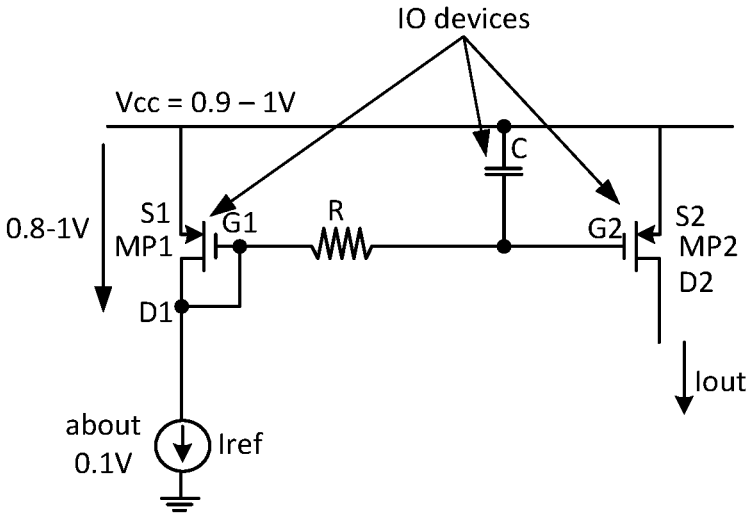
FIG. 3B is a circuit diagram illustrating exemplary voltage values of the current mirror circuit of FIG. 2 when the transistor MP1 and MP2 are IO devices.

FIG. 3A is a circuit diagram illustrating exemplary voltage values of the low-noise current mirror circuit of FIG. 2 when the transistor MP1 and MP2 are core devices. FIG. 3B is a circuit diagram illustrating exemplary voltage values of the current mirror circuit of FIG. 2 when the transistor MP1 and MP2 are IO devices. Referring to FIG. 3A, the transistors MP1 and MP2 are core devices each having a threshold voltage of about 0.4V to 0.5V so that there is a voltage of greater than 0.4V available for the current reference Iref. In contrast, referring to FIG. 3B, the transistors MP1 and MP2 are IO devices each having a relatively high threshold voltage of about 0.8V to 1V so that the current mirror circuit does not have a sufficient voltage margin for the operation of the current reference Iref when IO devices are used at low core-supply voltages.

Figure 4:
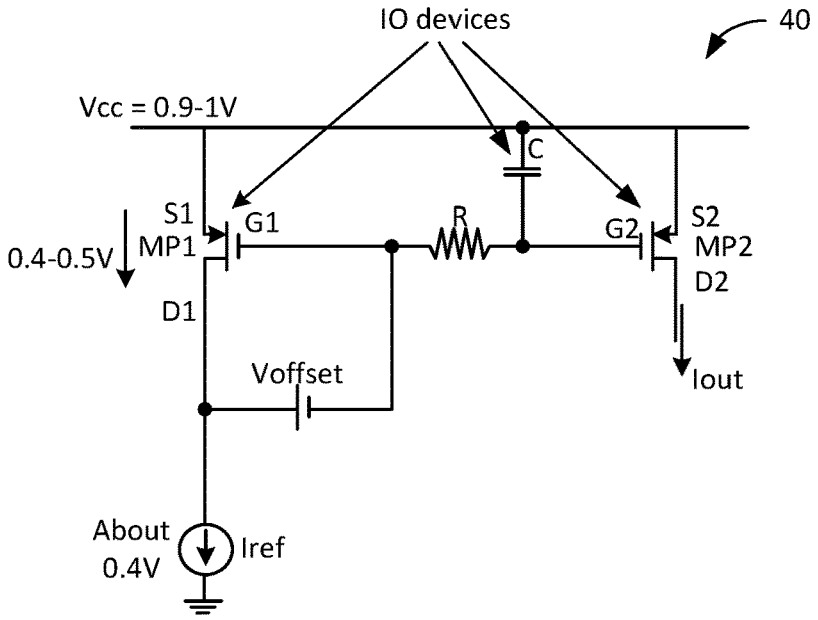
FIG. 4 is a circuit diagram of a low-noise current mirror circuit 40 according to an embodiment of the present invention.

FIG. 4 is a circuit diagram of a low-noise current mirror circuit 40 according to an embodiment of the present invention. Current mirror circuit 40 includes p-channel transistors MP1 and MP2, a current reference source Iref, a resistor R, a capacitor C, and a voltage offset circuit having an offset voltage Voffset. Transistors MP1 and MP2 each are 10 devices, i.e., transistors MP1 and MP2 each have a relatively high voltage threshold. Referring to FIG. 4, MP1 has a source S1 coupled to a core supply voltage Vcc (e.g. 0.9V to 1V), a gate G1 coupled to one end of resistor R and a drain D1 coupled one end of the current reference source Iref and one end of the voltage offset circuit Voffset. MP2 has a source S2 coupled to the core supply voltage Vcc, a gate G2 coupled to another end of the resistor R and one end of the capacitor C, and a drain D2 that provides an output current Iout to a load. In the embodiment, the offset voltage Voffset is added between the gate G1 and one end of the resistor R to ensure that the voltage at the drain D1 is high enough to provide at least 0.4V to the current reference source Iref.

Figure 5:
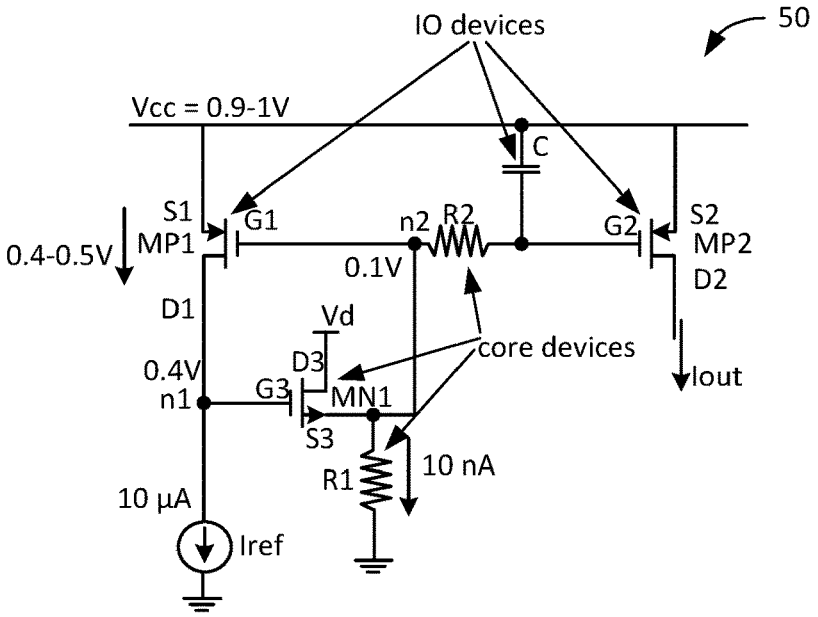
FIG. 5 is a schematic diagram of a low-noise and low voltage current mirror circuit 50 according to an embodiment of the present invention.

FIG. 5 is a schematic diagram of a low-noise and low voltage current mirror circuit 50 according to an embodiment of the present invention. Current mirror circuit 50 provides the advantages of low voltage supply, low noise reference current, and insensitivity to the supply voltage variations. Referring to FIG. 5, current mirror circuit 50 may include a first p-channel MOS (PMOS) transistor MP1, a second p-channel MOS transistor MP2, a current source Iref, an n-channel MOS (NMOS) transistor MN1, and a first resistive element R1 coupled between a source of the NMOS transistor MN1 and a ground potential. First PMOS transistor MP1 has a source S1 connected to a supply voltage Vcc, a drain D1 connected to the current source Iref at a node n1, and a gate G1 connected to the drain D1. NMOS transistor MN1 has a gate G3 connected to the current source Iref at the node n1, and a source S3 connected to the gate G1 of first transistor MP1 and to one end of first resistive element R1. Second PMOS transistor MP2 has a source S2 connected to the supply voltage Vcc, and a gate G2 connected to the gate G1 of first transistor MP1 through a second resistive element R2. Current mirror circuit 50 may further include a capacitive element C disposed between the supply voltage Vcc and the gate G2 of second transistor MP2. The second resistive element R2 has one end connected to the source S3 of NMOS transistor MN1 and the gate G1 of first PMOS transistor MP1 at a node n2. The second resistive element R2 and the capacitive element C form together a low-pass filter having a time constant R2C configured to filter noise of the current source Iref. In one embodiment, NMOS transistor MN1 is a native device or a core device such that transistor MN1 has a low threshold voltage.

In one embodiment, the n-channel MOS transistor MN1 is configured to compensate for the variation of the supply voltage Vcc. When the supply voltage Vcc rises, the voltage at the node n1 tends to rise. As the voltage at the node n1 is applied to the gate of the transistor MN1, the transistor MN1 tends to conduct less current, so that the voltage at the node n2 drops resulting in a drop of the drain voltage of first transistor MP1, thereby counteracting the rise of the supply voltage Vcc. The NMOS transistor operates as a negative feedback loop of the current path comprising the first transistor MP1 and the current source Iref of current mirror circuit 30.

In one embodiment, the n-channel transistor (NMOS) MN1 may be a transistor having a low threshold voltage of about 0.4V or lower. In one embodiment, the n-channel transistor MN1 may be a native transistor (e.g., with undoped channel) having a threshold voltage of approximately 0.1V or 0V. In one embodiment, the voltage Vd applied to the drain D3 of the NMOS transistor MN1 may be $Vd \geq Vg - Vt$, where Vd is the voltage applied to the drain of the NMOS transistor MN1, Vg is the voltage applied to the gate of the NMOS transistor MN1, and Vt is the threshold voltage of the NMOS transistor MN1.

In a numerical exemplary embodiment, a current mirror circuit in accordance with the present invention has a supply voltage in the range between 0.9V and 1.0V, a current source in the order of 10 μA, a voltage source-drain of the transistor MP1 is in the range between 0.4V and 0.5V, the voltage at the node n1 is about 0.4V, the voltage at the node n2 is about 0.1V, the current flowing through the resistor R2 is about 10 nA, and the resistive element R2 has a value about 10 MΩ. In one embodiment, since the drain voltage Vd has to be greater than Vg-Vt, where Vt is the threshold voltage of a native NMOS transistor, the drain voltage applied to the NMOS transistor may be chosen to be 0.6V.

Embodiments of the present invention may be utilized advantageously in a variety of applications. For example, the current mirror or the current reference circuit shown in FIGS. 4 and 5 may be used in conjunction with a digital-to-analog converter that employs an array of current sources to produce an analog output proportional to a digital input. Or, the current mirror circuit (the current reference circuit) shown in FIG. 4 or FIG. 5 may be used as an active load for amplifier stages because of its high output resistance. In one embodiment, the output current Iout can be provided to an external device (i.e., outside of the current mirror circuit) as a current source for biasing the external device.

Although specific embodiments have been illustrated and described herein, it will be appreciated by those of ordinary skill in the art that any arrangement that is derived to achieve the same purpose may be substituted for the specific embodiments shown. Many modifications of the invention will be apparent to those of ordinary skill in the art. Accordingly, this disclosure is intended to cover any modifications or variations of the invention. It is intended that this invention be limited only by the following claims and their equivalents.

What is claimed is:

1. A current reference circuit comprising:

a current source;

a first p-channel metal oxide semiconductor (PMOS) transistor having a source coupled to a first supply voltage, a gate, and a drain coupled to the current source;

an n-channel MOS (NMOS) transistor having a drain coupled to a second supply voltage, a gate coupled to the drain of the first PMOS transistor; and a first resistive element having a first terminal coupled to a source of the NMOS transistor and a gate of the first PMOS transistor and a second terminal coupled to a ground potential.

2. The current reference circuit of claim 1, wherein the first supply voltage is an input/output (TO) supply voltage, and the second supply voltage is a core voltage, the second supply voltage being lower than the first supply voltage.

3. The current reference circuit of claim 1, further comprising:

a second PMOS transistor having a drain coupled to the first supply voltage;

a second resistive element having a first terminal coupled to the first terminal of the first resistive element and a second terminal coupled to the gate of the second PMOS transistor.

4. The current reference circuit of claim 3, further comprising:

a capacitive element having a first terminal coupled to the first supply voltage and a second terminal coupled to the second terminal of the second resistive element.

5. The current reference circuit of claim 1, wherein the first supply voltage is about 0.9V to 1.0V, and the second supply voltage is about 0.6V.

6. The current reference circuit of claim 5, wherein the gate of the NMOS transistor has a voltage about 0.4V, and the gate of the first PMOS transistor has a voltage about 0.1V.

7. The current reference circuit of claim 6, wherein the current source has a current about 10 μA, and a current flowing through the first resistive element is about 10 nA.

8. The current reference circuit of claim 1, wherein the NMOS transistor is a native transistor having a threshold voltage equal to or less than 0.1 V.

9. A current mirror comprising:

a current source;

a first p-channel metal oxide semiconductor (PMOS) transistor having a source coupled to a first supply voltage, a gate, and a drain coupled to the current source;

a second PMOS transistor having a source coupled to the first supply voltage, a gate coupled to the gate of the first PMOS transistor, and a drain configured to provide a second current source; and an n-channel MOS (NMOS) transistor having a drain coupled to a second supply voltage, a gate coupled to the current source, and a source coupled to the gate of the first PMOS transistor.

10. The current mirror of claim 9, further comprising:

a first resistive element coupled between the source of the NMOS transistor and a ground potential;

a second resistive element coupled between the gate of the first PMOS transistor and the gate of the second PMOS transistor; and a capacitive element coupled between the first supply voltage and the gate of the second PMOS transistor.

11. The current mirror of claim 10, wherein the first supply voltage is about 0.9V to 1.0V, and the second supply voltage is about 0.6V.

12. The current mirror of claim 11, wherein the gate of the NMOS transistor has a voltage about 0.4V, and the gate of the first PMOS transistor has a voltage about 0.1V.

13. The current mirror of claim 12, wherein the current source has a current about 10 μA, and a current flowing through the first resistive element is about 10 nA.

14. The current mirror of claim 10, wherein the second resistive element has a resistance value of about 10 MΩ.

15. The current mirror of claim 9, wherein the NMOS transistor is a low threshold voltage transistor having a threshold voltage of about 0.3V.

16. The current mirror of claim 9, wherein the NMOS transistor is a native NMOS transistor.

17. An integrated current reference circuit comprising:

a first voltage source;

a voltage offset circuit having a first end and a second end;

a reference current having one end coupled to the second end of the voltage offset circuit and another end coupled to a ground potential;

a first p-channel transistor having a source coupled to the first voltage source, a gate coupled to the first end of the voltage offset circuit, and a drain coupled to the reference current;

a second p-channel transistor having a source coupled to the first voltage source, a gate coupled to the first end of the voltage offset circuit, and a drain configured to provide an output current, wherein the voltage offset circuit comprises:

a second voltage source;

an n-channel transistor having a drain coupled to the second voltage source, a gate coupled to the drain of the first p-channel transistor, and a source coupled to the gate of the first p-channel transistor; and a first resistor coupled between the source of the n-channel transistor and a ground potential.

18. The integrated current reference circuit of claim 17, further comprising:

a second resistor coupled between the gate of the first p-channel transistor and the gate of the second p-channel transistor; and a capacitor coupled between the first voltage source and the gate of the second p-channel transistor.

19. The integrated current reference circuit of claim 17, wherein the first p-channel transistor and the second p-channel transistor each have a first threshold voltage, and the n-channel transistor has a second threshold voltage that is lower than the first threshold voltage.

20. The integrated current reference circuit of claim 17, wherein the n-channel transistor is a native transistor having a threshold voltage equal to or less than 0.1 V.

* * * * *